US006644936B1

(12) United States Patent
Muta

(10) Patent No.: US 6,644,936 B1
(45) Date of Patent: Nov. 11, 2003

(54) SWASH PLATE TYPE REFRIGERANT COMPRESSOR

(75) Inventor: Shunji Muta, Saitama (JP)

(73) Assignee: Zexel Valeo Climate Control Corporation, Osato-gun (JP)

( * ) Notice: Subject to any disclaimer, the term of this patent is extended or adjusted under 35 U.S.C. 154(b) by 0 days.

(21) Appl. No.: 10/110,024

(22) PCT Filed: Oct. 10, 2000

(86) PCT No.: PCT/JP00/07021

§ 371 (c)(1),
(2), (4) Date: Apr. 4, 2002

(87) PCT Pub. No.: WO01/27473

PCT Pub. Date: Apr. 19, 2001

(30) Foreign Application Priority Data

Oct. 12, 1999 (JP) ..... 11-289801

(51) Int. Cl.[7] ..... F04B 1/20
(52) U.S. Cl. ..... 417/269; 92/158; 417/222.2
(58) Field of Search ..... 92/158, 159, 160; 184/6.17; 417/222.2, 269

(56) References Cited

U.S. PATENT DOCUMENTS

| | | | | | |
|---|---|---|---|---|---|
| 3,106,138 | A | * | 10/1963 | Thoma | 92/160 |
| 3,437,015 | A | * | 4/1969 | Kubilos | 92/160 |
| 4,776,260 | A | * | 10/1988 | Vincze | 417/269 |
| 5,174,728 | A | * | 12/1992 | Kimura et al. | 417/222.2 |
| 5,655,430 | A | * | 8/1997 | Richards | 417/269 |
| 5,816,134 | A | * | 10/1998 | Takenaka et al. | 92/159 |
| 5,921,756 | A | * | 7/1999 | Matsuda et al. | 417/269 |

FOREIGN PATENT DOCUMENTS

| | | |
|---|---|---|
| JP | 10-325389 | 12/1998 |
| JP | 11-241677 | 9/1999 |

* cited by examiner

*Primary Examiner*—Michael Koczo
(74) *Attorney, Agent, or Firm*—Frishauf, Holtz, Goodman & Chick, P.C.

(57) ABSTRACT

The outer diameter Φd1 of a top face-side end portion 35 of pistons 7 is made slightly smaller than the outer diameter Φd0 of a hollow cylindrical portion 36 of the pistons 7 other than the top face-side end portion 35. Thus, the tilt load of a top face-side portion of the piston 7 is divided and distributed, and at the same time, lubricating oil is held at the top face-side end portion 35 of the piston 7.

12 Claims, 9 Drawing Sheets

SWASH PLATE TYPE REFRIGERANT COMPRESSOR

This application is a U.S. National Phase Application under 35 USC 371 of International Application PCT/JP00/07021 (not published in English) filed Oct. 10, 2000.

TECHNICAL FIELD

This invention relates to a swash plate refrigerant compressor, and more particularly to a swash plate refrigerant compressor suitable for use as a refrigerant compressor for an automotive vehicle, using $CO_2$ (carbon dioxide) as a refrigerant.

BACKGROUND ART

FIG. 6 is a longitudinal cross-sectional view of a conventional swash plate refrigerant compressor, and FIG. 7 is an enlarged partial view of FIG. 6.

The swash plate refrigerant compressor includes a cylinder block 101 having a plurality of cylinder bores 106 formed therein, a shaft 105 rotatably supported in a central portion of the cylinder block 101, a swash plate 110 tiltably and slidably fitted on the shaft 105 and connected to a thrust flange 140 via a linkage 141, a crankcase 108 in which the swash plate 110 and the thrust flange 140 are received, and pistons 107 each of which is connected to the swash plate 110 via a shoe 150 which can perform relative rotation on a sliding surface 110*a* of the swash plate 110, the pistons 107 each reciprocating within a corresponding one of the cylinder bores 106 as the swash plate 110 rotates.

The inclination of the sliding surface 110*a* of the swash plate 110 with respect to an imaginary plane, not shown, orthogonal to the shaft 105 varies with pressure within the crankcase 108.

The shoe 150 is comprised of a dish-shaped shoe body 151 for relatively rollably supporting a forward end face of a ball 111*a* formed on one end of a connecting rod 111 and an annular washer 152 for relatively rollably supporting a rearward end face of the ball 111*a*.

A retainer 153 for retaining the washer 152 of the shoe 150 is mounted on a boss 110*b* of the swash plate 110 via a radial bearing 155. The retainer 153 is relatively rotatable with respect to the swash plate 110. The radial bearing 155 is prevented from falling off by a stopper 154. The connecting rod 111 has another end 111*b* thereof secured to a corresponding one of the pistons 107.

As the shaft 105 rotates, the swash plate 110 also rotates in a state inclined with respect to the imaginary plane orthogonal to the shaft 105. The rotation of the swash plate 110 causes relative rotation of the shoe 150 on the sliding surface 110*a* of the swash plate 110 with respect to the swash plate 110, whereby rotation of the swash plate 110 is converted into linear reciprocating motion of the piston 107.

As a result, the volume of a compression chamber 122 within the cylinder bore 6 changes, whereby suction, compression, and delivery of refrigerant gas are sequentially carried out to deliver an amount of refrigerant gas corresponding to an inclination angle of the swash plate.

It should be noted that since the swash plate 110 is inclined with respect to the imaginary plane orthogonal to the shaft 105, when the swash plate 110 receives a compression reaction force from the refrigerant gas, tilt loads R1, R2 of the piston 107 are generated as shown in FIG. 7.

In the case of the swash plate refrigerant compressor using $CO_2$ as the refrigerant, the difference (approximately 15 MPa at the maximum) between high pressure and low pressure is extremely large, so that a compression reaction force generated during compression of the refrigerant is larger than in a conventional swash plate refrigerant compressor using chlorofluorocarbon as the refrigerant. This results in increased tilt loads R1, R2 of the piston 107.

Further, in the case of the swash plate refrigerant compressor using $CO_2$ as the refrigerant, lubricating oil separated by an oil separator, not shown, arranged in an intermediate portion of a path from a discharge chamber 112 to a discharge port 103*a* is returned into the crankcase 108, and attached to an outer peripheral surface of a bottom face-side end portion of the piston 107 when the piston 107 is close to its bottom dead center position, whereby the lubricating oil is supplied into a corresponding one of the cylinder bores 106. However, since a piston clearance (i.e. a gap between the outer peripheral surface of a piston and the inner peripheral surface of a cylinder bore) is not large, the amount of lubricating oil supplied to a top face-side end portion of the piston 107 is small.

Moreover, the lubricating oil circulates within the compressor without flowing out into a refrigerating cycle, so that refrigerant gas drawn into a compression chamber 122 contains very little lubricating oil, and hence only a small amount of lubricating oil is supplied to the top face-side end portion of the piston 107, which increases a sliding frictional force between the top face-side end portion of the piston 107 and the cylinder bore 106.

Therefore, the cylinder bore 106 is prone to abrasion (biased abrasion), and a coating film on the outer peripheral surface of the piston 107 is prone to peel-off.

It is an object of the invention to provide a swash plate refrigerant compressor which is capable of dividing and distributing tilt loads of pistons as well as enhancing lubricating oil-holding capability of the pistons.

DISCLOSURE OF INVENTION

To achieve the above object, the present invention provides a swash plate refrigerant compressor including a cylinder block having a plurality of cylinder bores formed therein, a drive shaft rotatably supported in a central portion of the cylinder block, pistons slidably inserted in the cylinder bores, respectively, a swash plate for transmitting a driving force to the pistons, and a crankcase in which the swash plate is received, and wherein an outer diameter of a top face-side end portion of the pistons is slightly smaller than an outer diameter of a hollow cylindrical portion of the pistons other than the top face-side end portion.

The outer diameter of the top face-side end portion of each piston is slightly smaller than that of the hollow cylindrical portion of the piston other than the top face-side end portion, as described above. Therefore, the tilt load of the top face-side end portion of the piston is divided and distributed onto two points, and at the same time, lubricating oil is held on the top face-side end portion of the piston. This ensures high lubricating oil-holding capability of the top face-side end portion of the piston, and hence it is possible to enhance slidability of the piston without increasing the clearance between the outer peripheral surface of the piston (hollow cylindrical portion) and the inner peripheral surface of the corresponding cylinder bore (i.e. without degrading volumetric efficiency). As a result, wear of the cylinder bore is reduced, and a coating film on the outer peripheral surface of the piston is made more peel-proof.

Preferably, inclination of the swash plate varies with pressure within the crankcase to thereby change a stroke length of the pistons.

As the inclination of the swash plate (with respect to an imaginary plane orthogonal to the drive shaft) increases, the tilt load of the piston also increases. However, since the outer diameter of the top face-side end portion of the piston is slightly smaller than that of the hollow cylindrical portion of the piston other than the top face-side end portion, the tilt load of the top face-side end portion of the piston is divided and distributed onto two points, and at the same time, lubricating oil is held on the top face-side end portion of the piston, thereby maintaining slidability of the piston.

Preferably, the top face-side end portion of the pistons is tapered.

The top face-side end portion of the each of the pistons is tapered, as described above, and hence the amount of lubricating oil held on the top face-side end portion of the piston is increased, which further enhances the slidability of the piston.

Preferably, inclination of the swash plate varies with pressure within the crankcase to thereby change a stroke length of the pistons, and the top face-side end portion of the piston is tapered.

Preferably, a lubricating oil groove is circumferentially formed in an outer peripheral surface of the top face-side end portion of the pistons.

The lubricating oil groove is circumferentially formed on the top face-side end portion of the each of the pistons, as described above, and hence, the amount of lubricating oil held on the top face-side end portion of the piston is increased, which further enhances the slidability of the piston.

Preferably, inclination of the swash plate varies with pressure within the crankcase to thereby change a stroke length of the pistons, and a lubricating oil groove is circumferentially formed in an outer peripheral surface of the top face-side end portion of the pistons.

Preferably, the top face-side end portion of the pistons is tapered, and a lubricating oil groove is circumferentially formed in an outer peripheral surface of the top face-side end portion of the pistons.

Preferably, inclination of the swash plate varies with pressure within the crankcase to thereby change a stroke length of the each of the pistons, and the top face-side end portion of the pistons is tapered, a lubricating oil groove being circumferentially formed in an outer peripheral surface of the top face-side end portion of the piston.

Preferably, carbon dioxide is used as a refrigerant.

When carbon dioxide is used as the refrigerant as described above, a compression reaction force generated during the compression is larger than in a conventional swash plate refrigerant compressor using chlorofluorocarbon as the refrigerant, and hence tilt load is also increased. However, the tilt load of the top face-side end portion of the piston is distributed, and at the same time, lubricating oil is held on the top face-side end portion of the piston, so that it is possible to enhance slidability of the piston without increasing the clearance between the outer peripheral surface of the piston (hollow cylindrical portion) and the inner peripheral surface of the corresponding cylinder bore. As a result, wear of the cylinder bore is reduced, and a coating film on the outer peripheral surface of the piston is made more peel-proof.

BEST MODE OF CARRYING OUT THE INVENTION

The invention will now be described in detail with reference to drawings showing preferred embodiments thereof.

Figure 2:
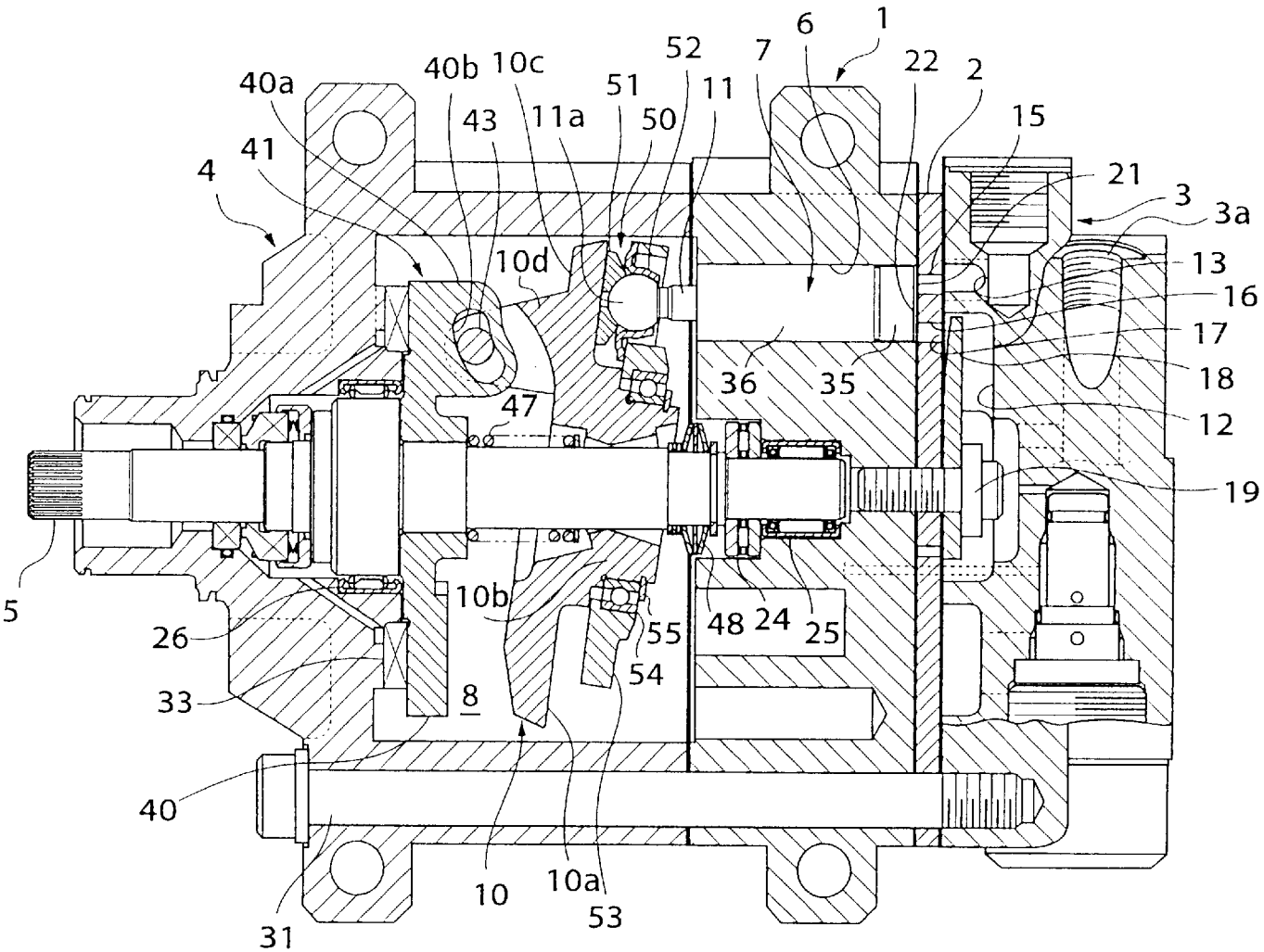
FIG. 2 is a longitudinal cross-sectional view of the swash plate refrigerant compressor including the FIG. 1 piston.

FIG. 2 is a longitudinal cross-sectional view of a swash plate refrigerant compressor according to a first embodiment of the invention.

The swash plate refrigerant compressor is used as a component of a refrigerator using $CO_2$ (carbon dioxide) as the refrigerant. The swash plate refrigerant compressor has a cylinder block 1 having one end thereof secured to a rear head 3 via a valve plate 2 and the other end thereof secured to a front head 4. The front head 4, the cylinder block 1, the valve plate 2 and the rear head 3 are tightened in a longitudinal direction by through bolts 31 to form a one-piece assembly.

The cylinder block 1 has a plurality of cylinder bores 6 axially extending therethrough at predetermined circumferential intervals about a shaft (drive shaft) 5. Each cylinder bore 6 has a piston 7 slidably received therein.

The front head 4 defines therein a crankcase 8 in which a swash plate 10 and a thrust flange 40, referred to hereinafter, are received. On the other hand, within the rear head 3, there are formed a suction chamber 13 and a discharge chamber 12 in a manner such that the suction chamber 13 surrounds the discharge chamber 12. The suction chamber 13 receives a low-pressure refrigerant gas to be supplied to each compression chamber 22, while the discharge chamber 12 receives a high-pressure refrigerant gas delivered from each compression chamber 22.

The shaft 5 has one end thereof rotatably supported by a radial bearing 26 within the front head 4 and the other end thereof rotatably supported by a thrust bearing 24 and a radial bearing 25 within the cylinder block 1.

The thrust flange 40 is fixedly fitted on the shaft 5, for rotation in unison with the same. The swash plate 10 is tiltably and slidably mounted on the shaft 5. Further, the swash plate 10 is connected to the thrust flange 40 via a linkage 41, for rotation in unison with the thrust flange 40 as the thrust flange 40 rotates. The inclination of a sliding surface 10*a* of the swash plate 10 with respect to an imaginary plane, not shown, orthogonal to the shaft 5 varies with pressure within the crankcase 8.

The swash plate 10 and each piston 7 are connected to each other via a shoe 50. The shoe 50 is comprised of a dish-shaped shoe body 51 for relatively rollably supporting a forward end face of a ball 11*a* formed on one end of a connecting rod 11, and an annular washer 52 for relatively rollably supporting a rearward end face of the ball 11*a*.

A retainer 53 for retaining the washer 52 of the shoe 50 is mounted on a boss 10*b* of the swash plate 10 via a radial bearing 54. The retainer 53 is relatively rotatable with respect to the swash plate 10. The radial bearing 54 is prevented from falling off by a stopper 55. The connecting rod 11 has the other end thereof secured to a corresponding one of the pistons 7.

The valve plate 2 is formed with refrigerant outlet ports 16 for each communicating between a compression chamber 22 and the discharge chamber 12, and refrigerant inlet ports 15 for each communicating between a compression chamber 22 and the suction chamber 13. The refrigerant outlet ports 16 and the refrigerant inlet ports 15 are arranged at predetermined circumferential intervals about the shaft 5. The refrigerant outlet ports 16 are opened and closed by respective discharge valves 17. The discharge valves 17 has a fixing portion fixed to a rear head-side end face of the valve plate 2 by a bolt 19 together with a valve stopper 18. On the other hand, the refrigerant inlet ports 15 are opened and closed by respective suction valves 21. The suction valves 21 have a fixing portion fixed to a front head side end face of the valve plate 2.

The thrust flange 40 rigidly fitted on the shaft 5 is rotatably supported on an inner wall surface of the front head 4 by a thrust bearing 33. The thrust flange 40 and the swash plate 10 are connected to each other via the linkage 41 as described above, and the swash plate 10 is tiltable with respect to the imaginary plane orthogonal to the shaft 5. The linkage 41 is comprised of a pair of projections 10*d* formed on a front surface 10*c* of the swash plate 10, an arm 40*a* extending from a swash plate-side end face of the thrust flange 40, and a link pin 43 extending between the two projections 10*d*, for engagement with a slot 40*b* formed through the arm 40*a*.

A coil spring 47 is fitted on the shaft 5 between the thrust flange 40 and the swash plate 10 to urge the swash plate 10 rearward, while a coned disc spring 48 is fitted on the shaft 5 between the thrust bearing 24 and the boss 10*b* of the swash plate 10 to urge the swash plate 10 frontward.

Figure 1:
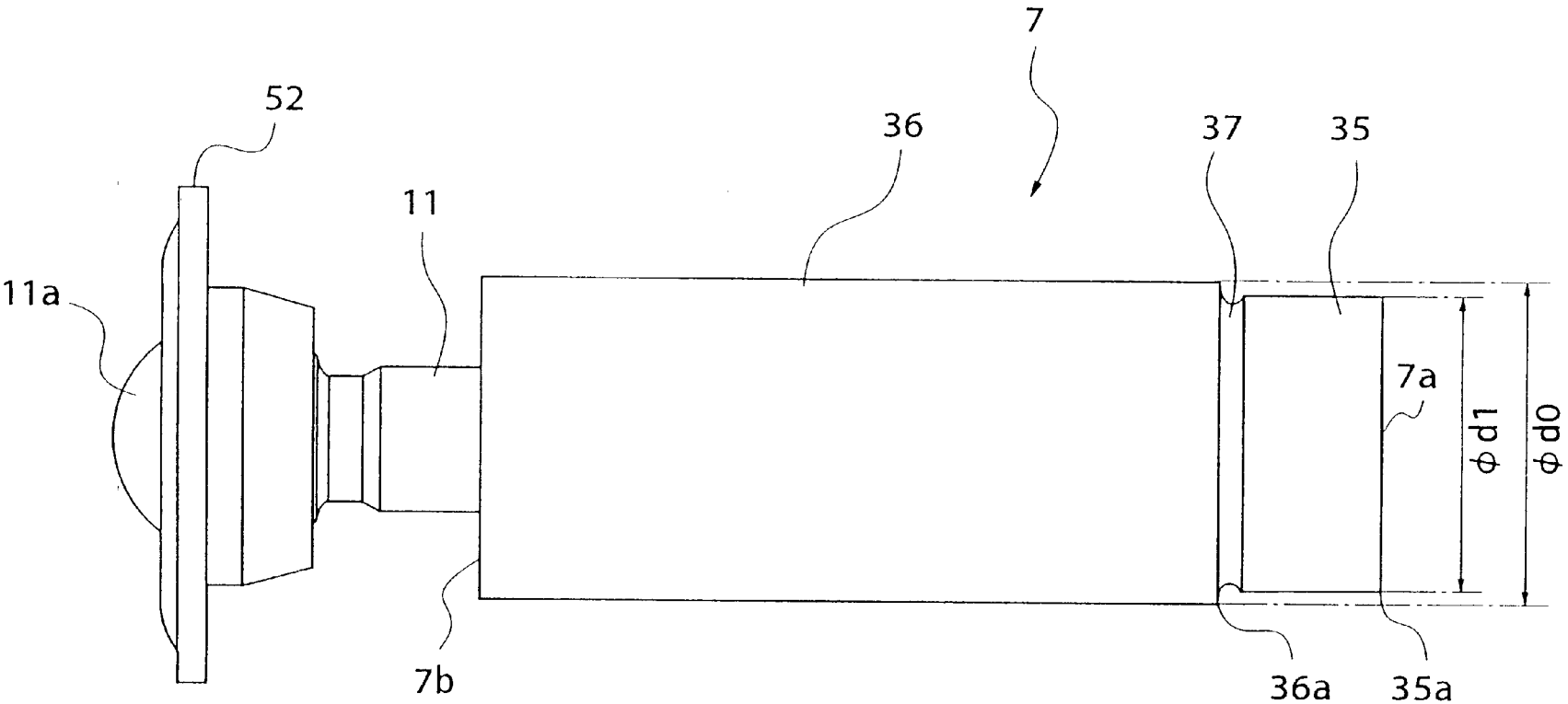
FIG. 1 is an enlarged side view of a piston of a swash plate refrigerant compressor according to a first embodiment of the invention.

FIG. 1 is an enlarged side view of the piston.

The piston 7 has an annular groove 37 circumferentially formed in a peripheral surface thereof. A top face-side end portion 35 (i.e. a portion extending between the annular groove 37 and a top face 7*a*) of the piston 7 has an outer diameter Φd1 which is slightly smaller than an outer diameter Φd0 of a hollow cylindrical portion 36 (i.e. a portion extending from the annular groove 37 to a bottom face 7*b*) other than the top face-side end portion 35. The ratio between the outer diameter Φd1 of the top face-side end portion 35 and the outer diameter Φd0 of the hollow cylindrical portion 36 is determined as follows.

Figure 3:
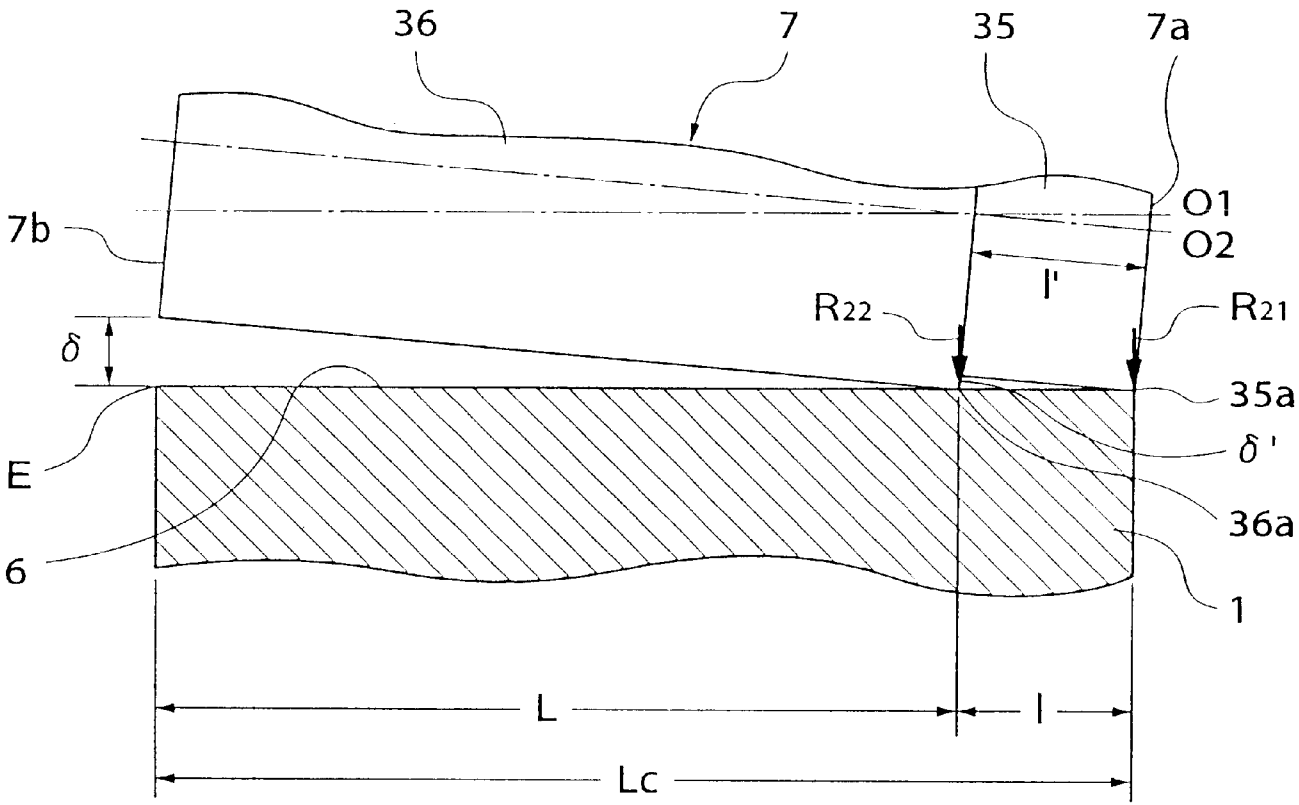
FIG. 3 is an enlarged partial longitudinal cross-sectional view showing the piston in a tilted state.

FIG. 3 is an enlarged partial cross-sectional view showing the piston 7 in a tilted state. In the figure, however, the annular groove 37 is omitted for simplicity of description.

In the figure, Lc represents a length of the cylinder bore in a direction of a central axis O1 thereof; L represents a length between a crankcase-side open edge E of the cylinder bore 6 and a top face-side edge 36*a* of the hollow cylindrical portion 36 in the direction of the central axis O1; 1 represents a length between the top face-side edge 36*a* of the hollow cylindrical portion 36 and an edge 35*a* of the top face-side end portion 35 in the direction of the central axis O1; δ represents a length of a gap between the inner peripheral surface of the cylinder bore 6 and the outer peripheral surface of the hollow cylindrical portion 36; δ represents a length between the outer peripheral surface of the hollow cylindrical portion 36 and an outer peripheral surface of the top face-side end portion 35; and 1' represents a length of the top face-side end portion 35 in a direction of a piston axis O2. It should be noted that l' is approximately equal to 1.

A relationship defined by the following equation hold between δ, L, δ' and l:

$$\delta/L=\delta'/l \tag{1}$$

Further, L+l=Lc×(0.8 to 1) holds. Lc is multiplied by (0.8 to 1), taking into account a case where the piston 7 is not at its top dead center position.

$$L=Lc\times(0.8 \text{ to } 1)-1 \tag{2}$$

From the equations (1) and (2), $$\delta'=(\delta\times 1)/\{Lc\times(0.8 \text{ to } 1)-1\} \tag{3}$$

By the equation (3), δ' can be calculated which represents the length from the outer peripheral surface of the hollow cylindrical portion 36 to the outer peripheral surface of the top face-side end portion 35 (i.e. the difference between the radius of the hollow cylindrical portion 36 and the radius of the top face-side end portion 35).

Next, the operation of the variable capacity swash plate compressor constructed as above will be described.

Torque of an engine, not shown, installed on an automotive vehicle, not shown, is transmitted to the shaft 5 to rotate the same. The rotation of the shaft 5 is transmitted to the swash plate 10 via the thrust flange 40 and the linkage 41, whereby the swash plate 10 tilted with respect to the imaginary plane orthogonal to the shaft 5 rotates along with rotation of the shaft 5.

The rotation of the swash plate 10 causes rotation of each shoe 50 on the sliding surfaces 10*a* of the swash plate 10, whereby the torque of the swash plate 10 is converted into linear reciprocating motion of each piston 7.

As the piston 7 reciprocates within the cylinder bore 6 associated therewith, the volume of the compression chamber 22 within the cylinder bore 6 changes. As a result, suction, compression, and delivery of refrigerant gas are sequentially carried out to deliver an amount of refrigerant gas corresponding to the inclination angle of the swash plate 10.

During the suction, the suction valve 21 opens to draw low-pressure refrigerant gas from the suction chamber 13 into the compression chamber 22 within the cylinder bore 6 associated therewith. During the discharge, the discharge valve 17 opens to deliver high-pressure refrigerant gas from the compression chamber 22 to the discharge chamber 12. Lubricating oil is separated from the refrigerant gas delivered into the discharge chamber 12, by an oil separator, not shown. Then, the separated lubricating oil is returned into the crankcase 8, while the refrigerant gas is delivered to a cooler, not shown, via a discharge port 3*a*.

When thermal load on the compressor decreases to increase the pressure within the crankcase 8, the inclination angle of the swash plate 10 becomes smaller, and hence the stroke length of the piston 7 is decreased to reduce the delivery quantity or capacity of the compressor. On the other hand, when thermal load on the compressor increases to reduce the pressure within the crankcase 8, the inclination angle of the swash plate 10 becomes larger, whereby the stroke length of the piston 7 is increased to increase the delivery quantity or capacity of the compressor.

During the compression, a compression reaction force of refrigerant gas acts on the swash plate 10. Since $CO_2$ is used as the refrigerant, the compression reaction force of the refrigerant gas is larger than when chlorofluorocarbon is used as the refrigerant, as described hereinbefore, and hence the tilt load of each piston is also larger. However, the outer diameter Φd1 of the top face-side end portion 35 of the piston 7 is slightly smaller than the outer diameter Φd0 of the hollow cylindrical portion 36. More specifically, the outer diameter Φd1 of the top face-side end portion 35 of the piston 7 is 2×δ' smaller than the outer diameter Φd0 of the hollow cylindrical portion 36. Therefore, the tilt load of the top face-side portion of the piston 7 is divided and distributed onto two points (i.e. a point which receives the tilt load of the top face-side edge 36*a* of the hollow cylindrical portion 36 and a point which receives the tilt load of the edge 35*a* of the top face-side end portion 35) as respective tilt loads R21, R22 (see FIG. 3). It should be noted that the surface of the piston 7 has an elastically deformable film (polytetrafluoroethylene) formed thereon, so that when the piston 7 is tilted, the top face-side portion of the piston 7 is easy to abut on the inner peripheral surface of the cylinder bore 6 at the two points.

Further, during operation of the compressor, when the piston 7 is at its bottom dead center position, lubricating oil in the crankcase 8 is attached to the piston 7, and then, when the piston 7 is shifting from its bottom dead center position to its top dead center position, the lubricating oil is supplied into the cylinder bore 6. Since the outer diameter Φd1 of the top face-side end portion 35 of the piston 7 is slightly smaller than the outer diameter Φd0 of the hollow cylindrical portion 36, lubricating oil scrubbed from the inner peripheral surface of the cylinder bore 6 by the top face-side edge 36*a* of the hollow cylindrical portion 36 is held on the top face-side end portion 35 and in the lubricating oil groove 37.

According to the above first embodiment, the tilt load of the top face-side portion of the piston 7 is divided and distributed onto the two points (locations) as the respective tilt loads R21, R22, and at the same time the lubricating oil-holding capability of the top face-side end portion 35 of the piston 7 is improved, so that wear of the cylinder bore 6 is reduced, and the coating film on the outer peripheral surface of the piston 7 is made more peel-proof. It is also possible to prevent seizure of the piston 7.

Further, since the top face-side end portion 35 of the piston 7 has a high lubricating oil-holding capability, it is possible to reduce the clearance δ between the outer peripheral surface of the piston (hollow cylindrical portion 36) and the inner peripheral surface of the cylinder bore 6 without degrading slidability of the piston 7, thereby suppressing degradation of volumetric efficiency. In other words, if the improvement of slidability of the piston 7 is only intended, it could be achieved simply by increasing the clearance δ, which, however, would cause degradation of volumetric efficiency.

Also, since the piston 7 is formed with the annular groove 37, the lubricating oil-holding capability of the piston 7 is further enhanced.

Figure 8:
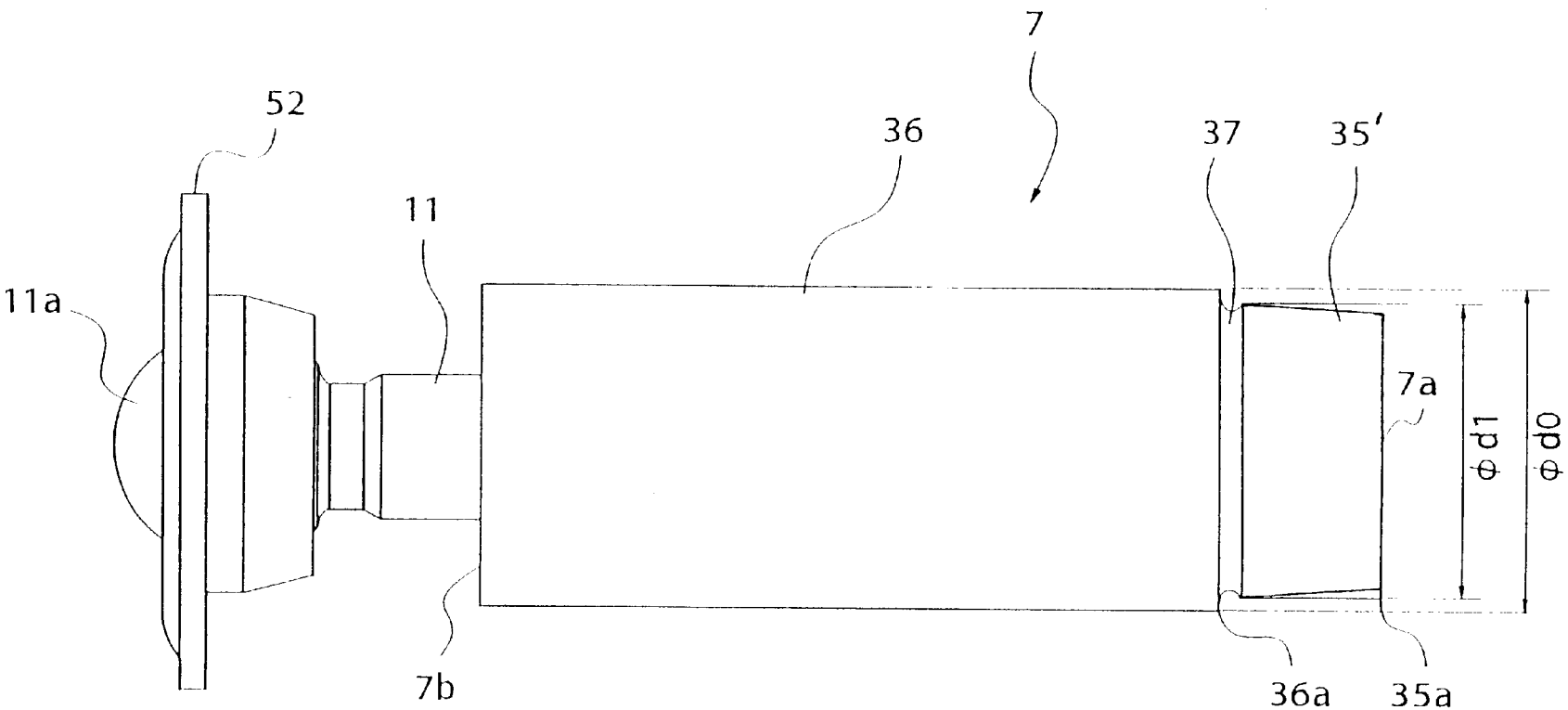
FIG. 8 shows the arrangement of FIG. 1 with a tapered end portion of the piston.

Although in the above first embodiment, the entire top face-side end portion 35 of the piston 7 has a uniform outer diameter Φd1, a variation may be employed in which the top face-side end portion 35' is tapered, i.e., it has an outer diameter Φd1 progressively decreasing from the annular groove 37 toward the top face 7*a*. See FIG. 8.

Further, although in the above embodiment, the top face-side end portion 35 is formed with the single annular groove 37, a plurality of annular grooves 37 may be formed on the top face-side end portion 35. This makes it possible to further improve the lubricating oil-holding capability of the piston 7.

Figure 4:
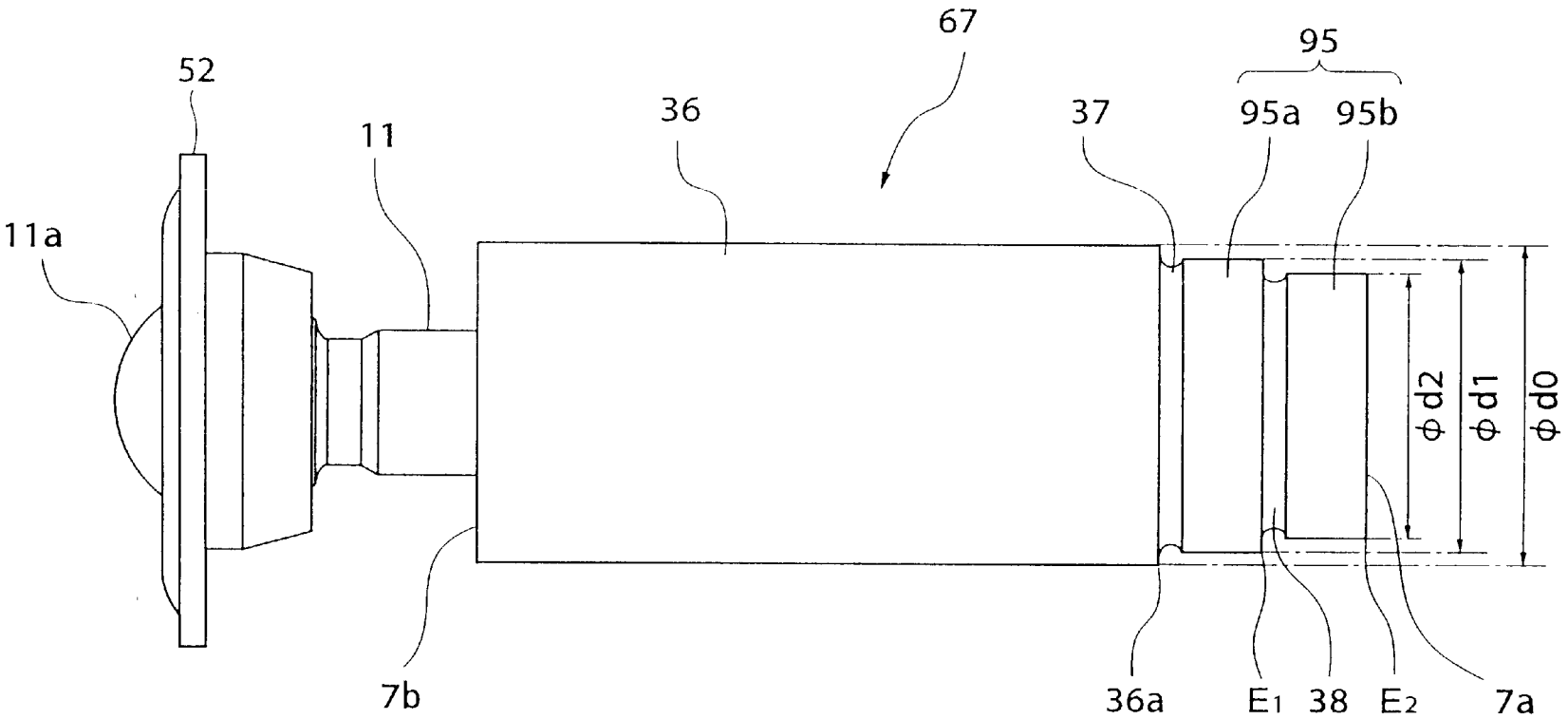
FIG. 4 is an enlarged side view of a piston of a swash plate refrigerant compressor according to a second embodiment of the invention.

FIG. 4 is an enlarged side view of a piston of a swash plate refrigerant compressor according to a second embodiment of the invention. Portions similar to those of the above embodiment are designated by identical reference numerals, and detailed description thereof is omitted.

In the first embodiment in FIG. 1, the outer diameter Φd1 of the entire top face-side end portion 35 of the piston 7 is fixed, and the single annular groove 37 is formed on the top face-side end portion 35, in the second embodiment, a top face-side end portion 95 is formed with not only an annular groove 37 but also another annular groove 38, and the top face-side end portion 95 is divided by the annular groove 38 into a large diameter portion 95*a* and a small diameter portion 95*b*. The relationship between an outer diameter Φd0 of a hollow cylindrical portion 36, an outer diameter Φd1 of the large diameter portion 95*a* of the top face-side end portion 95, and an outer diameter Φd2 of the small diameter portion 95*b* of the top face-side end portion 95 is expressed as follows:

$$\Phi d0 > \Phi d1 > \Phi d2$$

When the piston 67 is tilted, the tilt load of a top face-side portion of the piston 67 is divided and distributed onto three points (i.e. a point which receives the tilt load of a top face-side edge 36*a* of the hollow cylindrical portion 36, a point which receives the tilt load of an edge E1 of the large diameter portion 95*a* of the top face-side end portion 95, and a point which receives the tilt load of an edge E2 of the small diameter portion 95*b* of the top face-side end portion 95) at the maximum.

According to the second embodiment, since the tilt load of the top face-side portion of the piston 67 is always divided and distributed onto a plurality of points (three points at the maximum), wear of the cylinder bore 6 is positively reduced, and a coating film on the outer peripheral surface of the piston 67 is made more peel-proof.

Figure 5:
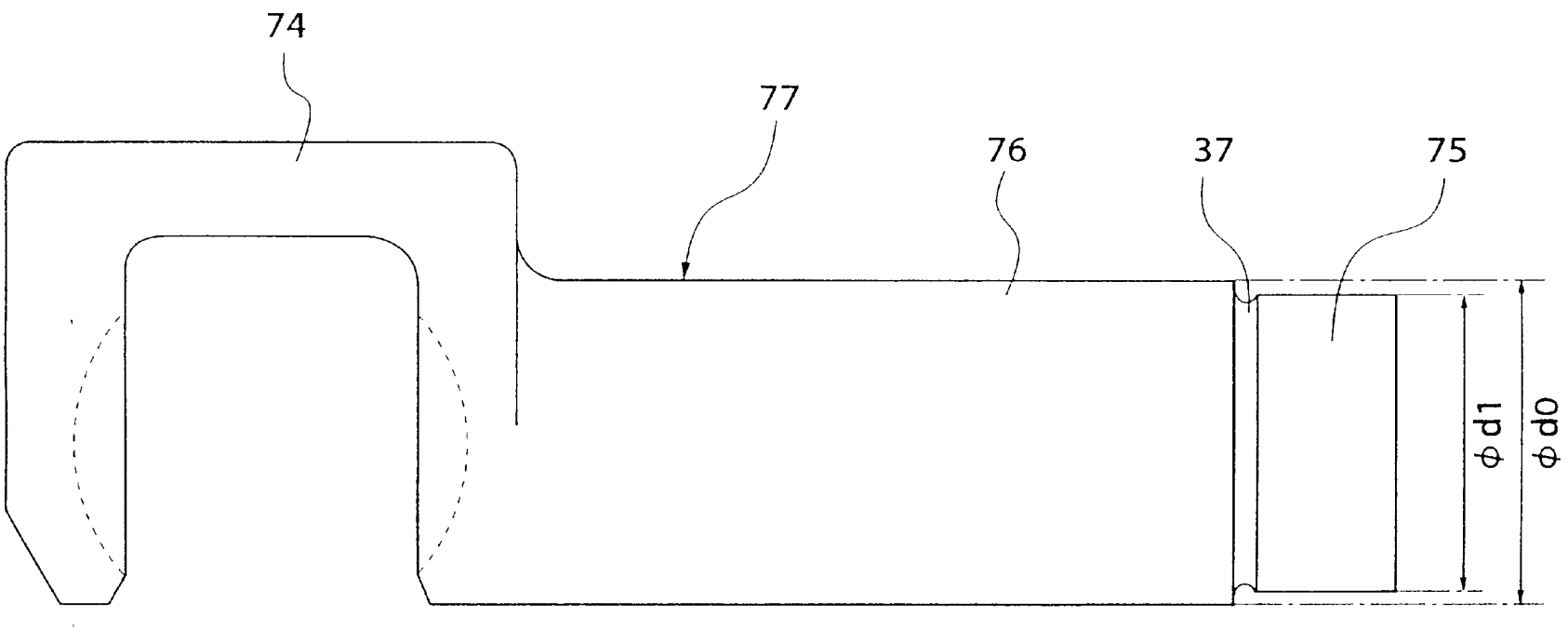
FIG. 5 is an enlarged side view of a piston of a swash plate refrigerant compressor according to a third embodiment of the invention.
Figure 6:
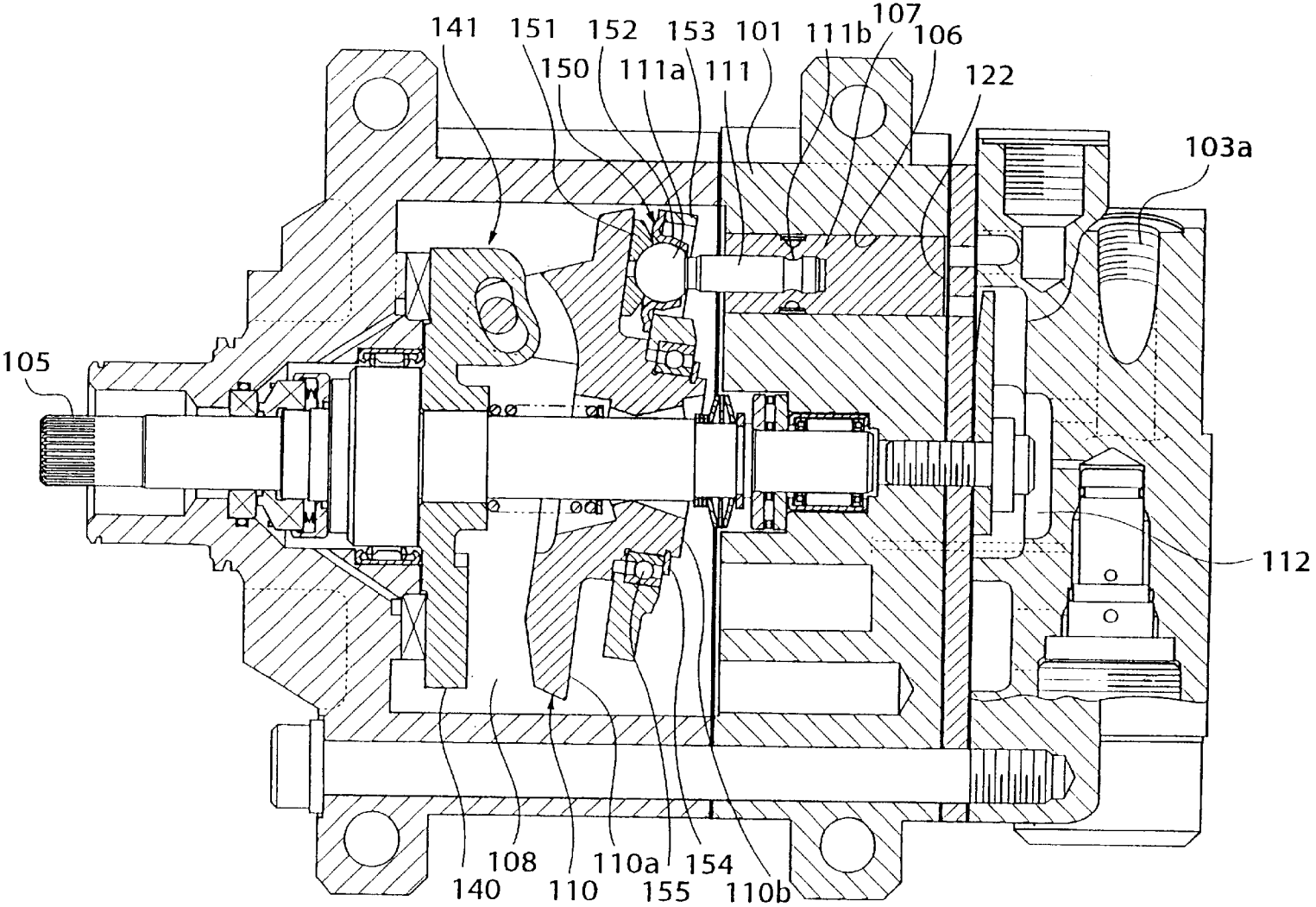
FIG. 6 (PRIOR ART)
FIG. 6 is a longitudinal cross-sectional view of a conventional swash plate refrigerant compressor.
Figure 7:
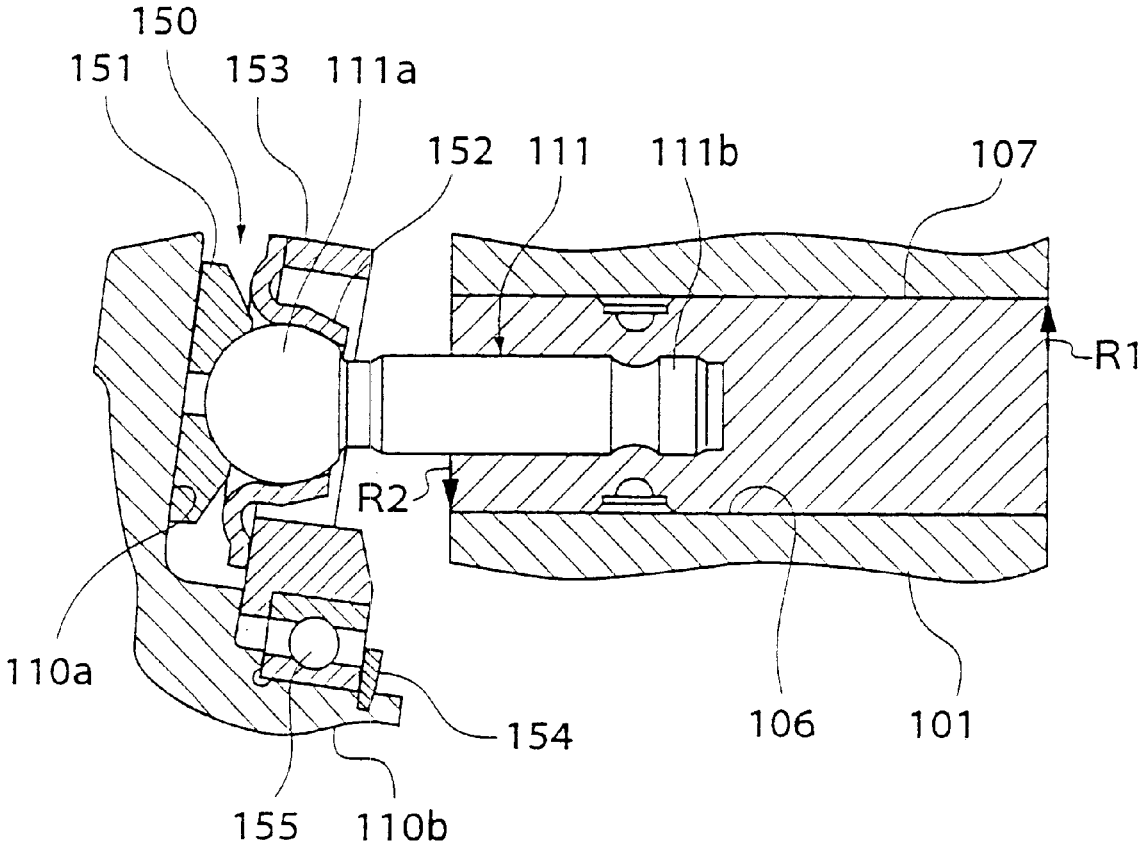
FIG. 7 (PRIOR ART)
FIG. 7 is an enlarged partial view of FIG. 6.

FIG. 5 is an enlarged side view of a piston of a swash plate refrigerant compressor according to a third embodiment of the invention.

Although in each of the above embodiments, the invention is applied to a type of the swash plate refrigerant compressor configured such that the connecting rod 11 is provided between the shoe 50 and the piston 7 or 67, the present invention may be applied to another type of the swash plate refrigerant compressor configured such that a shoe, not shown, is directly supported by one end portion 74 of a piston 77.

An outer diameter Φd1 of a top face-side end portion 75 of the piston 77 is slightly smaller than an outer diameter Φd0 of a hollow cylindrical portion 76. More specifically, the outer diameter Φd1 of the top face-side end portion 75 is smaller than the outer diameter Φd0 of the hollow cylindrical portion 76 by 2×δ'.

The value δ' can be determined in the same manner as in the first embodiment shown in FIG. 1.

The present embodiment can provide the same effects as obtained by the first embodiment in FIG. 1.

Figure 9:
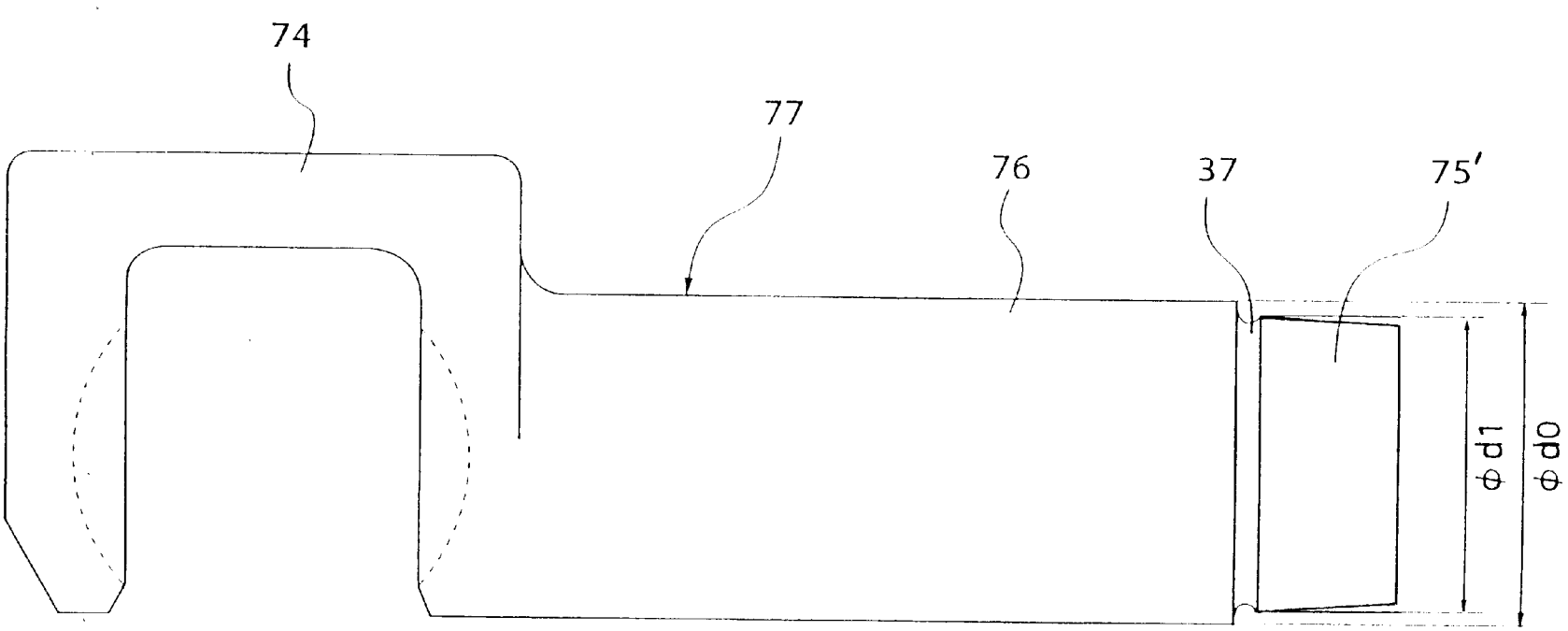
FIG. 9 shows the arrangement of FIG. 5 with a tapered end portion of the piston.

As a variation of the third embodiment, similarly to the second embodiment in FIG. 4, the top face-side end portion 75 may be formed with a plurality of annular grooves. Further, the top face-side end portion 75 may be divided into a large diameter portion and a small diameter portion, or alternatively, as shown in FIG. 9, the top face-side end portion 75' may be tapered.

Although in each of the above embodiments, the variable capacity swash plate refrigerant compressor is described as an example of the swash plate refrigerant compressor, this is not limitative, but the present invention is applicable to a fixed capacity swash plate refrigerant compressor. Further, the swash plate refrigerant compressor of the present invention includes a wobble plate refrigerant compressor, to which the present invention is applicable. In this case, a wobble plate of the wobble plate refrigerant compressor corresponds to the swash plate of the swash plate refrigerant compressor of the present invention.

Moreover, although in each of the above embodiments, the swash plate refrigerant compressor uses carbon dioxide as the refrigerant, the invention may be applied to a swash plate refrigerant compressor using chlorofluorocarbon as the refrigerant.

Industry Applicability

As described above, the swash plate refrigerant compressor according to the invention is useful as a refrigerant compressor for use in an air conditioning system installed on an automotive vehicle. According to this swash plate refrigerant compressor, wear of each cylinder bore is reduced, and at the same time a coating film on the outer peripheral surface of each piston is made more peel-proof.

What is claimed is:

1. A swash plate refrigerant compressor comprising:

a cylinder block having a plurality of cylinder bores formed therein;

a drive shaft rotatably supported in a central portion of said cylinder block;

pistons slidably inserted in said cylinder bores, respectively, said pistons each having a top face-side end portion, and a hollow cylindrical portion other than the top face-side end portion, the top face-side end portion having an outer diameter slightly smaller than an outer diameter of the hollow cylindrical portion;

a swash plate for transmitting a driving force to said pistons; and a crankcase in which said swash plate is received.

2. A swash plate refrigerant compressor according to claim 1, wherein inclination of said swash plate varies with pressure within said crankcase to thereby change a stroke length of said pistons.

3. A swash plate refrigerant compressor according to claim 1, wherein the top face-side end portion of said pistons is tapered.

4. A swash plate refrigerant compressor according to claim 1, wherein inclination of said swash plate varies with pressure within said crankcase to thereby change a stroke length of said pistons, and wherein the top face-side end portion of said piston is tapered.

5. A swash plate refrigerant compressor according to claim 1, wherein a lubricating oil groove is circumferentially formed in an outer peripheral surface of the top face-side end portion of said pistons.

6. A swash plate refrigerant compressor according to claim 1, wherein inclination of said swash plate varies with pressure within said crankcase to thereby change a stroke length of said pistons, and wherein a lubricating oil groove is circumferentially formed in an outer peripheral surface of the top face-side end portion of said pistons.

7. A swash plate refrigerant compressor according to claim 1, wherein the top face-side end portion of said pistons is tapered, and wherein a lubricating oil groove is circumferentially formed in an outer peripheral surface of the top face-side end portion of said pistons.

8. A swash plate refrigerant compressor according to claim 1, wherein inclination of said swash plate varies with pressure within said crankcase to thereby change a stroke length of said each of said pistons, wherein the top face-side end portion of said pistons is tapered, and wherein a lubricating oil groove is circumferentially formed in an outer peripheral surface of the top face-side end portion of said piston.

9. A swash plate refrigerant compressor according to claim 1, wherein carbon dioxide is used as a refrigerant.

10. A swash plate refrigerant compressor according to claim 2, wherein carbon dioxide is used as a refrigerant.

11. A swash plate refrigerant compressor according to claim 3, wherein carbon dioxide is used as a refrigerant.

12. A swash plate refrigerant compressor according to claim 4, wherein carbon dioxide is used as a refrigerant.

* * * * *